US005313704A

United States Patent [19]

Atsumi et al.

[11] Patent Number: 5,313,704

[45] Date of Patent: May 24, 1994

[54] ELECTRIC SHAVER

[75] Inventors: Yukihiko Atsumi; Teruo Hishiki; Makoto Onodera, all of Tokyo, Japan

[73] Assignee: U.S. Philips Corporation, New York, N.Y.

[21] Appl. No.: 977,485

[22] Filed: Nov. 17, 1992

[30] Foreign Application Priority Data

Nov. 18, 1991 [JP] Japan ..... 3-301833

[51] Int. Cl.[5] ..... B26B 19/28

[52] U.S. Cl. ..... 30/43.6; 30/89

[58] Field of Search ..... 30/43.6, 43.4, 43.5, 30/87, 88, 89, DIG. 2; 474/62, 63, 205

[56] References Cited

U.S. PATENT DOCUMENTS

| | | | |
|---|---|---|---|
| 2,194,815 | 3/1940 | Testi | 30/43 |
| 3,797,109 | 3/1974 | Yamada et al. | 30/43.1 |
| 4,257,161 | 3/1981 | Bijl et al. | 30/43.6 |
| 4,515,577 | 5/1985 | Cathey et al. | 474/205 |
| 4,634,410 | 1/1987 | Tangorra et al. | 474/205 |
| 4,663,842 | 5/1987 | Bosch | 30/43.6 |
| 4,722,721 | 2/1988 | Wetzel | 474/205 |
| 4,910,869 | 3/1990 | Labrijn | 30/43.6 |
| 5,007,168 | 4/1991 | Messinger et al. | 30/43.6 |
| 5,031,315 | 7/1991 | Labrijn | 30/41 |

FOREIGN PATENT DOCUMENTS

| | | |
|---|---|---|
| 0176128 | 4/1986 | European Pat. Off. . |
| 0375949 | 7/1990 | European Pat. Off. . |

*Primary Examiner*—Richard K. Seidel
*Assistant Examiner*—Hwei-Siu Payer
*Attorney, Agent, or Firm*—Ernestine C. Bartlett

[57] ABSTRACT

An electric shaver comprises a housing (1) formed as a grip, a shaving head (2) comprising at least one cutting unit (11) having an outer cutting member (16) and an inner cutting member which is rotatable relative to the outer cutting member, and drive element for driving the inner cutting member, the shaving head being pivotably connected to the housing. In known shavers the motor is accommodated in the shaving head, resulting in a poor balance and poor contact between the shaving head and the skin. According to the invention the shaver is characterized in that a motor (5) belonging to the drive element is accommodated inside the housing (1), the drive element being adapted to follow the pivotal movements of the shaving head (2) relative to the housing. Preferably, the drive element comprises flexible coupling element, for example a pulley-belt transmission (9, 12, 15) but alternatively the drive element may comprise a universal joint.

2 Claims, 4 Drawing Sheets a b c a b c

ELECTRIC SHAVER

FIELD OF THE INVENTION

The present invention relates to an electric shaver comprising a housing formed as a grip, a shaving head comprising at least one cutting unit having an outer cutting member and an inner cutting member which is rotatable relative to the outer cutting member, and drive means for driving the inner cutting member, said shaving head being pivotably connected to said housing.

BACKGROUND OF THE INVENTION

Such an electric shaver is known from EP-A-0,176,128. A disadvantage of this known shaver is that the motor is accommodated in the shaving head so that the shaving head is bulky and inconvenient in use. During use the comparatively large weight of the shaving head results not only in a poor balance but also in poor contact between the shaving head and the skin.

SUMMARY OF THE INVENTION

Therefore, an object of the invention is to provide an electric shaver which is well balanced to provide convenient operation and whose shaving head is tilted in use to adapt itself to the contour of the skin to be shaved.

In order to achieve the above object an electric shaver according to the invention is characterized in that a motor belonging to the drive means is accommodated inside said housing, said drive means between the motor and said inner cutting member being adapted to follow the pivotal movements of the shaving head relative to the housing.

By accommodating the motor in the housing, which is formed as a grip for holding the shaver, the center of gravity is transferred to a more favourable location. This reduces the weight of the shaving head, as a result of which the shaving head is tilted easily so that during its movement over the skin the shaving head can readily follow the contour of the skin. This yields an improved shaving performance. Due to the pivotable connection of the shaving head to the housing, which accommodates the motor, the drive means follow the pivotal movements of the shaving head relative to the housing during shaving.

Preferably, the drive means comprise coupling means which are flexible, for example a pulley-belt transmission. This provides greater freedom in developing the various parts of the electric shaver. It enables the thickness of the housing to be reduced if the shaving surface of the shaving head is substantially coplanar with a main surface of the housing in the non-pivoted position of the shaving head relative to the housing.

A further embodiment of the invention is characterized in that in a non-pivoted position of the shaving head relative to the housing an output shaft of the motor is substantially perpendicular to an axis of rotation of the rotatable inner cutting member, the drive means comprise bevel gears in driving engagement with the output shaft of said motor, and the pulley-belt transmission comprises a toothed pulley driven by one of the bevel gears, another toothed pulley for driving the inner cutting member, and a toothed belt between said toothed pulleys.

In another embodiment of the invention the drive means comprise a universal joint. In this embodiment the shaving surface of the shaving head can also be substantially coplanar with a main surface of the largest housing. This main surface is generally the or one of the two largest planar surfaces of the housing.

Apart from the drive means as used in the embodiments described above it is possible to use drive means formed by a motor having a flexible output shaft coupled directly to the inner cutting member or having an output shaft coupled to the inner cutting member via an intermediate flexible shaft.

BRIEF DESCRIPTION OF THE DRAWINGS

The invention will now be described in more detail, by way of example, with reference to the drawings, in which.

DETAILED DESCRIPTION OF THE PREFERRED EMBODIMENTS

Figure 1:
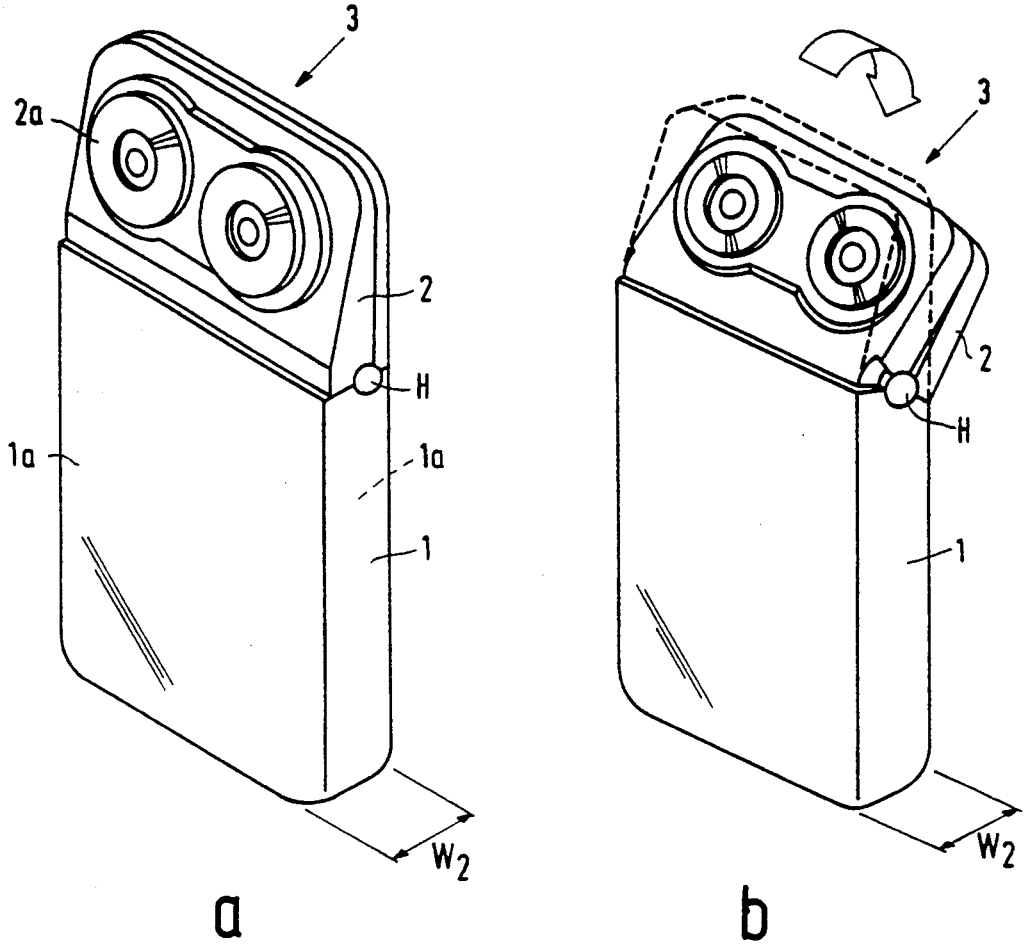
FIG. 1*a* is a diagrammatic perspective view of an electric shaver in accordance with the invention in a non-pivoted position of the shaving head, in which the axis of rotation of the inner cutting member is perpendicular to the motor shaft.
FIG. 1*b* is a diagrammatic perspective view showing the electric shaver of FIG. 1*a* with the shaving head pivoted into an extreme position.

FIG. 1*a* shows an electric shaver comprising a flat housing 1 and a shaving head 2 in a non-pivoted position of the head, which is pivotably connected to the housing 1 by a hinge H, and FIG. 1*b* shows the electric shaver with the shaving head pivoted into an extreme position indicated in solid lines, the non-pivoted position of the shaving head, i.e. when the shaving head is not pressed against the skin, being indicated in broken lines. The shaving surface 2*a* of the shaving head, i.e. the outer surface of the outer cutting member, is substantially coplanar with one of the main surface 1*a* of the housing. Such an arrangement enables the thickness W2 of the housing of the shaver to be reduced to, for example, 15 mm.

Figure 2:
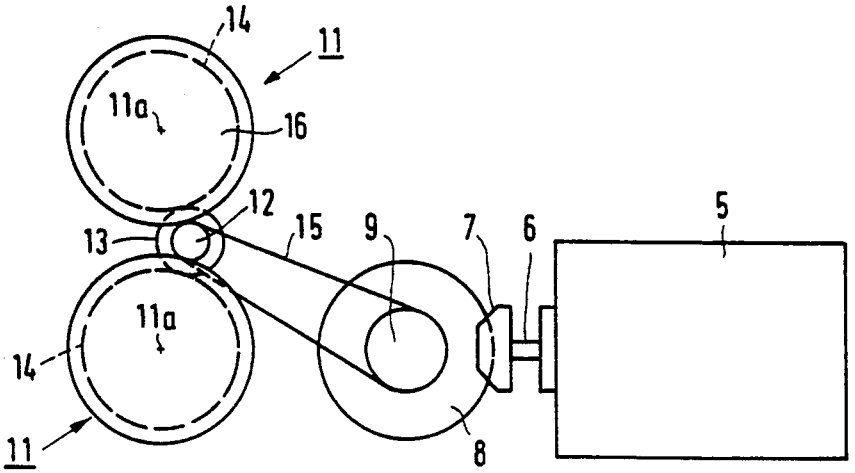
FIGS. 2*a*, 2*b* and 2*c* show a first embodiment of the invention having drive means comprising flexible coupling means in a diagrammatic plan view, in an elevational side view with the shaving head in a non-pivoted position, and in an elevational side view with the shaving head in a pivoted position respectively.
Figure 2:
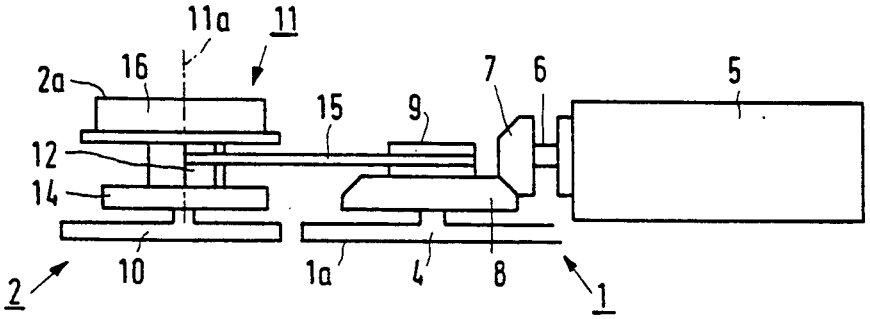
Figure 2:
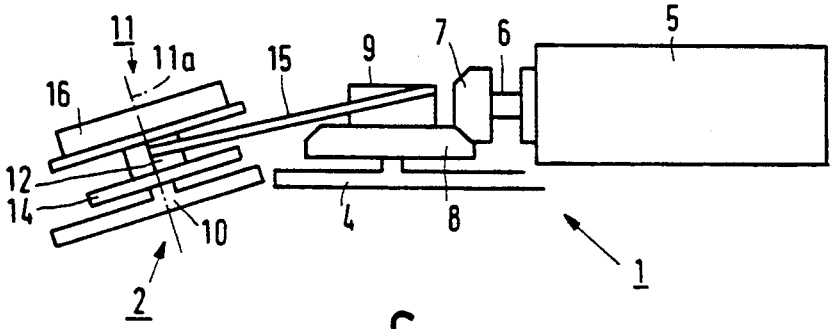
Figure 3:
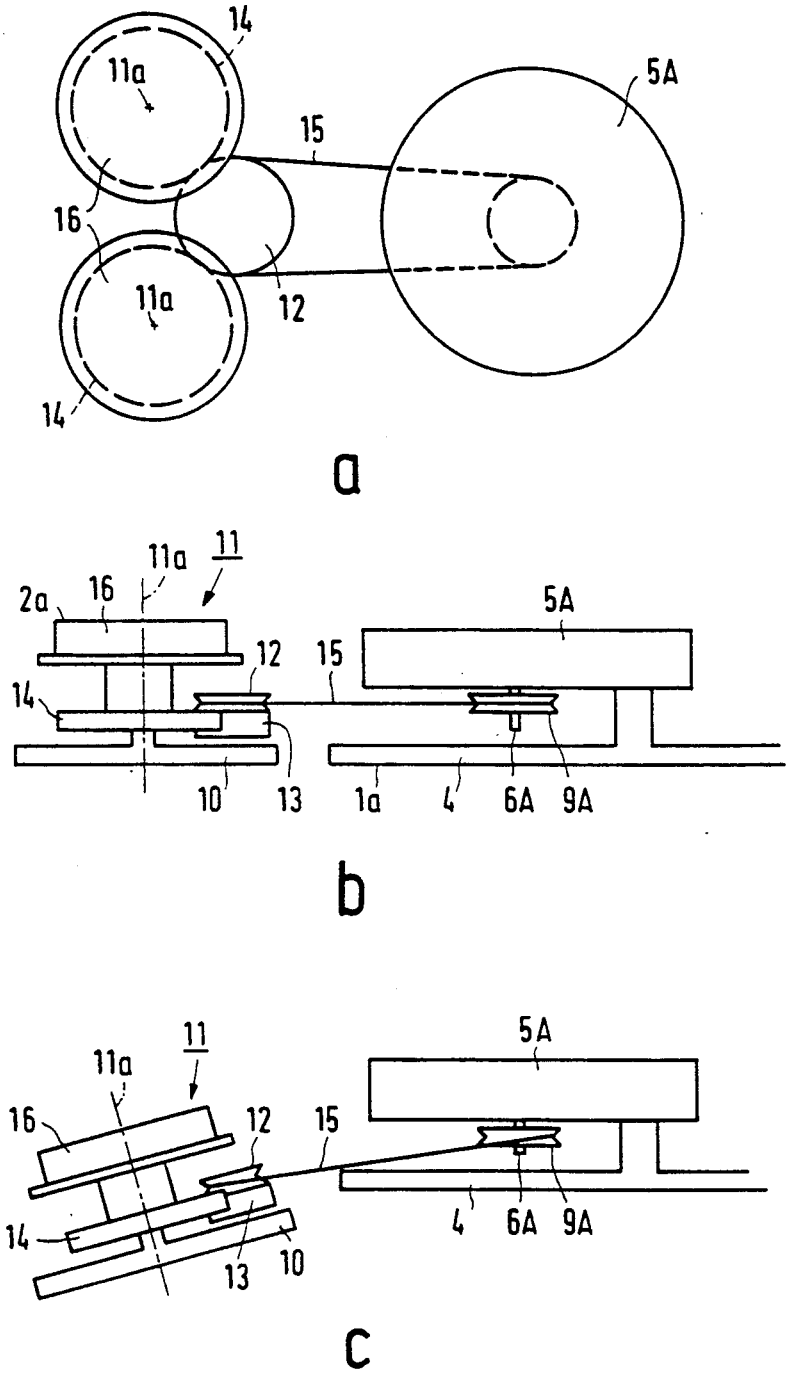
FIGS. 3*a*, 3*b* and 3*c* are diagrammatic views similar to those in FIGS. 2*a*, 2*b* and 2*c* respectively, showing a second embodiment of the invention in which the drive means comprise flexible coupling means but in which the output motor shaft is oriented differently.
Figure 4:
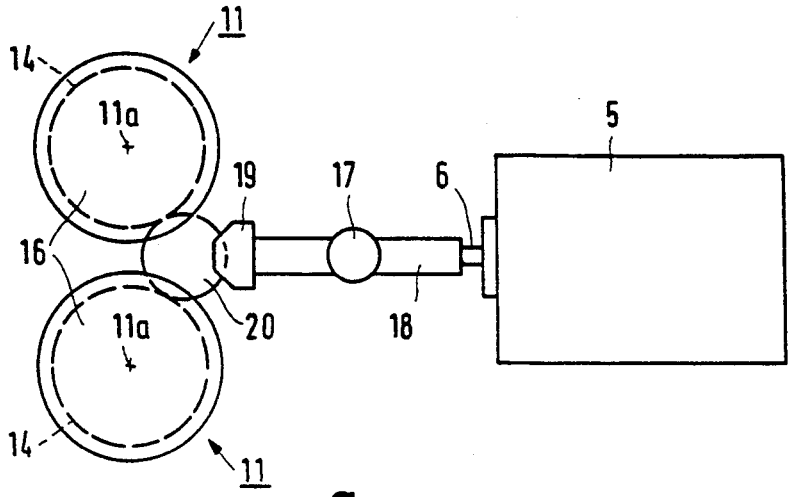
FIGS. 4*a*, 4*b* and 4*c* are diagrammatic views similar to the FIGS. 2*a*, 2*b* and 2*c* respectively, showing a third embodiment of the invention in which the drive means comprise a universal joint.
Figure 4:
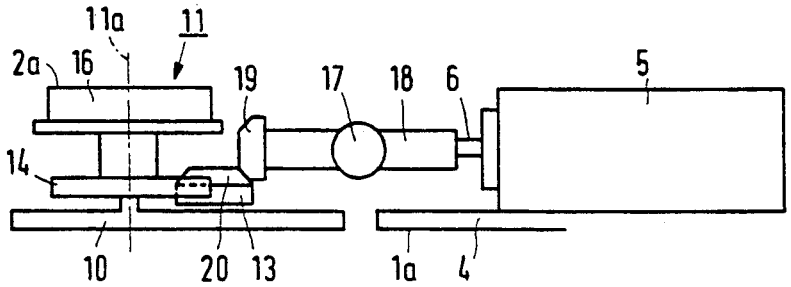
Figure 4:
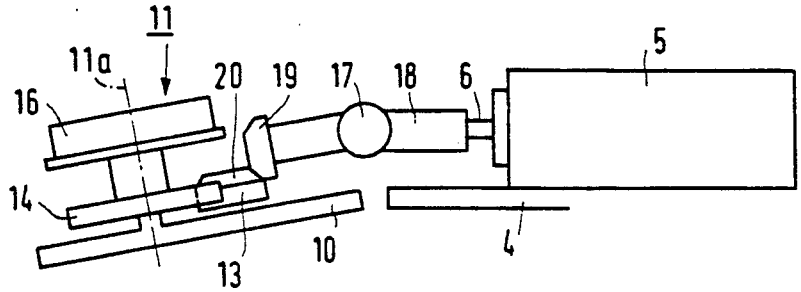

The shaving head 2 comprises two cutting units 3 each having an outer cutting member 16 and an inner cutting member (not shown) which is rotatable relative to the outer cutting member by means of a spindle, not shown, about an axis of rotation (11*a*, see FIGS. 2, 3, 4). The cutting members of the cutting units define a shaving surface 2*a* of the shaving head 2, which shaving surface is substantially coplanar with one of the main surfaces 1*a* of the housing 1. A drive motor 5 for the cutting units is arranged inside the housing 1.

When the shaver is not actually used for shaving the shaving head 2 is in the position shown in broken lines in FIG. 1*b*. During shaving the force between the shaving head and the skin causes the shaving head to be pivoted against spring force and to assume a pivoted position as shown in solid lines in FIG. 1*b*. A click mechanism may be provided to hold the shaving head 2 in the non-pivoted position.

In a first embodiment shown in FIGS. 2*a*, 2*b* and 2*c* a bevel gear 7 is mounted on a forward end of a rotary output shaft 6 of a motor 5, which shaft 6 extends parallel to a base plate 4 of the housing and parallel to the said main surface 1*a* of the housing. The bevel gear 7 is in mesh with a bevel gear 8, which is rotatably supported on a spindle projecting perpendicularly from the base plate 4. The bevel gear 8 carries a toothed pulley 9. The shaving head 2 comprises a base plate 10. The axes of rotation 11*a* of the rotatable inner cutting members of the two cutting units 11 extend perpendicularly to the base plate 10. Each cutting unit comprises a gear 14 meshing with a common drive gear 13 for the inner cutting members. Each cutting unit further comprises a toothed pulley 12. A toothed belt 15 is arranged between the toothed pulley 9 and the toothed pulley 12. The toothed pulleys 9 and 12 and the toothed belt 15 cooperate with each other to form flexible coupling means between the rotary output shaft 6 of the motor arranged inside the housing 1 and the spindles of the rotatable inner cutting members of the cutting units 11 arranged inside the shaving head. This arrangement ensures that, even if the shaving head 2 is inclined relative to the housing 1 as shown in FIG. 1*b*, the driving force of the motor is transmitted to the gears 14 of the respective cutting units 11 by the toothed pulleys 9 and 12 and the toothed belt 15 as shown in FIG. 2*c*. Thus, it is possible to drive inner cutting members inside outer cutting members 16 of the cutting units through expandable and pivotable spindles (not shown) provided on the respective gears 14.

In a second embodiment shown in FIGS. 3*a*, 3*b*, and 3*c* the motor 5A has a planar body with an output shaft 6A perpendicular to the base plate 4. The motor is secured to the base plate in an overhanging manner. A toothed pulley 9A is mounted directly on the output shaft 6A. A driving force is transmitted to a toothed timing pulley 12 in order to drive the inner cutting members via a toothed belt 15. In the same way as in the first embodiment the toothed pulleys 9A and 12 and the toothed belt 15 cooperate with each other to form flexible coupling means between the rotary output shaft 6A of the motor arranged inside the housing and spindles of rotatable inner cutting members of the respective cutting units 11 arranged inside the shaving head.

In a third embodiment shown in FIGS. 4*a*, 4*b* and 4*c* the motor shaft 6 of the motor 5 has the same orientation as in the first embodiment. The drive means comprise a universal joint 17 at an intermediate location of a drive shaft 18 having one end connected to the rotary output shaft 6 of the motor and carrying a bevel gear 19 at its other end. The bevel gear 19 is in mesh with a bevel gear 20 which is integral with an intermediate gear 13, which is in mesh with a pair of gears 14 for rotatably driving the inner cutting members. The universal joint in this embodiment is not a flexible coupling in the literal sense but is also capable of transmitting the required angular drive.

We claim:

1. An electric shaver comprising a housing formed as a grip, a shaving head comprising at least one cutting unit having an outer cutting member and an inner cutting member which is rotatable relative to the outer cutting member, and drive means for driving the inner cutting member, said drive means comprising a drive motor having an output shaft, a flexible pulley-belt transmission coupling the output shaft and the inner cutting member, said shaving head being pivotably connected to said housing, said drive motor being accommodated inside said housing, and said drive means between the drive motor and said inner cutting member being adapted to follow the pivotal movements of the shaving head relative to the housing.

2. An electric shaver comprising a housing formed as a grip, a shaving head comprising at least one cutting unit having an outer cutting member and an inner cutting member which is rotatable relative to the outer cutting member, and drive means for driving the inner cutting member, said drive means comprising a drive motor having an output shaft, a flexible pulley-belt transmission coupling the output shaft and the inner cutting member, said shaving head being pivotably connected to said housing, said drive motor being accommodated inside said housing, and said drive means between the drive motor and said inner cutting member being adapted to follow the pivotal movements of the shaving head relative to the housing, and wherein:

in a non-pivoted position of the shaving head relative to the housing said output shaft of the motor is substantially perpendicular to an axis of rotation of the rotatable inner cutting member, the drive means also comprise bevel gears in driving engagement with the output shaft of the motor, and the pulley-belt transmission comprises a toothed pulley driven by one of the bevel gears, another toothed pulley for driving the inner cutting member, and a toothed belt between said toothed pulleys.

* * * * *